United States Patent [19]

Nakamura et al.

[11] Patent Number: 4,515,172

[45] Date of Patent: May 7, 1985

[54] COIN STACKING APPARATUS FOR A COIN PACKAGING MACHINE OR THE LIKE

[75] Inventors: Minoru Nakamura; Kazuto Asami, both of Himeji, Japan

[73] Assignee: Glory Kogyo Kabushiki Kaisha, Hyogo, Japan

[21] Appl. No.: 436,480

[22] Filed: Oct. 25, 1982

[30] Foreign Application Priority Data

Oct. 28, 1981 [JP] Japan ..... 56-171386

[51] Int. Cl.[3] ..... G07D 9/04

[52] U.S. Cl. ..... 133/8 A; 133/8 E; 53/254

[58] Field of Search ..... 133/1 A, 8 R, 8 A, 8 B, 133/8 C, 8 D, 8 E; 53/212, 213, 254; 414/91, 98, 100, 901

[56] References Cited

U.S. PATENT DOCUMENTS

| | | | |
|---|---|---|---|
| 3,532,230 | 10/1970 | Gutberlet et al. | 414/901 X |
| 3,933,254 | 1/1976 | Pulver et al. | 414/100 X |
| 4,058,955 | 11/1977 | Nakai et al. | 53/212 |
| 4,412,550 | 11/1983 | Watanabe et al. | 133/8 A |

FOREIGN PATENT DOCUMENTS

| | | | |
|---|---|---|---|
| 2913706 | 10/1980 | Fed. Rep. of Germany | 53/212 |
| 48-31352 | 9/1973 | Japan . | |
| 52-7360 | 3/1977 | Japan . | |
| 52-32461 | 7/1977 | Japan . | |

*Primary Examiner*—F. J. Bartuska

*Attorney, Agent, or Firm*—Beveridge, DeGrandi and Weilacher

[57] ABSTRACT

An improved coin stacking apparatus serving as a preliminary means for a coin packing machine or the like is disclosed, wherein the improvement consists in that a predetermined number of coins are stacked in a stacking space as defined by a pair of endless belts located opposite to each other with the aid of coin supports fixedly secured to the inner portions of the endless belts. The coins to be stacked are delivered into the stacking space by way of a coin passage using a conveyor endless belt. Coin stacking is effected by way of the steps of receiving a coin on the coin supports as if it rides thereon, lowering them stepwise by a distance equivalent to the thickness of a single coin and repeating the above two steps until the predetermined number of coins are stacked one above another. A control system is provided for the apparatus and it is operated so as to control a driving mechanism for the pair of endless belts in response to a signal transmitted from a coin detecting device while a predetermined height difference is always kept between the working surface of the coin passage and the upper face of the stacked structure of coins.

7 Claims, 6 Drawing Figures

COIN STACKING APPARATUS FOR A COIN PACKAGING MACHINE OR THE LIKE

BACKGROUND OF THE INVENTION

The present invention relates to a coin stacking apparatus and more particularly to an improved coin stacking apparatus serving as a preparative means for a coin disposing machine such as a coin packaging machine or the like.

When a number of coins are to be packed in the form of a cylinder, packing operation is conventionally carried out by way of the steps of counting a predetermined number of coins, inserting them into a coin stacking sleeve one by one, building a stacked structure of coins in the sleeve and delivering the stacked structure to a packaging station where it is packaged with a wrapping or packaging paper.

The coins to be stacked in the coin stacking sleeve are introduced thereinto one by one by allowing them to fall down freely toward a receiving plate due to their own dead weight, and the receiving plate is disposed at the lower opened part of the sleeve. This causes the coins to fall down by a long height and therefore there is a tendency that they assume a vertical posture due to their abutment against the inner wall of the sleeve during the free falling in the sleeve, resulting in no correct stacked structure of coins built up therein. Once any one of introduced coins assumes a vertical posture in the stacked structure, correct packing fails to be carried out in the subsequent process or station.

To obviate the abova-mentioned problem with respect to the conventional coin stacking sleeve a few improvements were already proposed as disclosed in Japanese Patent Publication No. 7360/1977 and Japanese Utility Model Publication No. 32461/1977. The improvements consist in that a vertically displaceable receiving plate is horizontally inserted in the stacking sleeve under resilient force imparted by a coil spring which is effective in causing the receiving plate to be normally raised up until the top end of a stacked structure of coins abuts against a roller disposed at the upper end of the sleeve. Coins to be stacked are introduced into the sleeve one by one by depressing the stacked structure against the resilient force of the coil spring without any possibility of causing any one of them to assume a vertical posture. Further, another improvement as disclosed in Japanese Utility Model Publication No. 31352/1973 is such that a receiving plate adapted to move up and down in the coin stacking sleeve with the aid of a cam is horizontally inserted therein and coin stacking is carried out as the receiving plate is lowered stepwise at every counting of a coin to be stacked.

In any one of the above improvements the receiving plate is designed to move up and down in the coin stacking sleeve and there is a necessity of transporting a stacked structure of coins to the next process or station after a predetermined number of coins are stacked in the sleeve and then allowing the receiving plate to resume the initial elevated position where it is ready to receive coins. Specifically, to displace the stacked structure of coins from the coin stacking sleeve it is required that the receiving plate is removed from the sleeve so as to allow the stacked structure of coins to be displaced in the downward direction and after completion of transportation of the latter the receiving plate is inserted into the sleeve until it is raised up to the initial elevated position.

Therefore, the hitherto proposed improvements have drawbacks of complicated structure and long idle time until the next coin stacking operation is initiated. This is because of the fact that delivery of coins to the coin stacking sleeve is inhibited until the receiving plate removed therefrom for the purpose of transportation of the stacked structure of coins is inserted thereinto and resumed the initial elevated position.

Again, the drawbacks inherent to the conventional coin stacking apparatuses will be described below from another point of view.

The conventional coin stacking apparatus as disclosed in Japanese Patent Publication No. 7360/1977 and Japanese Utility Model Publication No. 32461/1977 is constructed such that the receiving plate is normally urged toward the upper roller under resilient force of the coil spring and coins to be stacked are introduced into the coin stacking sleeve against the resilient force of the coil spring and the frictional force existing between the outer surface of the stacked structure of coins and the inner wall of the coin stacking sleeve. Since the frictional force increases as the number of stacked coins increases, smooth coin introduction becomes difficult stepwise as the coins are stacked one by one in the coin stacking sleeve.

Another conventional coin stacking apparatus as disclosed in Japanese Utility Model Publication No. 31352/1973 is constructed such that the receiving plate in the coin stacking sleeve is in operative association with the coin counting mechanism so as to allow it to be lowered stepwise as coins are introduced thereinto. Owing to the above-described arrangement the conventional coin stacking apparatus does not include the drawback inherent to the foregoing conventional one. However, since the former has a constant relation between the counting number of coins to be stacked and the lowered distance of the receiving plate at all time irrespective of the thickness of the coins and thus there is a necessity of determining a lowered distance of the receiving plate in accordance with the highest thickness of coins when a variety of coins having a different thickness are to be stacked, the result is that a height difference between a coin entrance through which coins to be stacked are introduced into the coin stacking sleeve and the upper face of the stacked structure of coins increases as the number of stacked coins increases, resulting in an elongated distance by which they fall down freely due to their own dead weight. Thus, there is caused a tendency that some of them assumes a vertical posture while they fall down and thereby it can be concluded that the last mentioned conventional coin stacking apparatus fails to resolve the problem with respect to an occurrence of a vertical posture.

SUMMARY OF THE INVENTION

Hence, the present invention is intended to obviate all of the drawbacks inherent to the above-mentioned conventional coin stacking apparatuses. Accordingly, it is an object of the present invention to provide a coin stacking apparatus serving as a preparative means for a coin packing machine or the like which ensures that coin stacking is carried out with substantially reduced idle time between successive coin stacking operations without any danger that some of delivered coins assumes a vertical posture during the coin stacking operation.

To satisfactorily accomplish the above-mentioned object there is proposed a coin stacking apparatus for stacking vertically in a stacking space a plurality of coins fed horizontally along a coin passage in a coin disposing machine such as a coin packaging machine or the like, the upper opening of the stacking space being close to the front end of the coin passage, the lower face of the space being released after a predetermined number of coins have been stacked so that the stacked coins are fed to a next process, characterized in that a pair of endless belts are disposed vertically so that the inner travelling portions of the endless belts are opposite to each other to define the stacking space with a certain distance kept therebetween; that first and second coin supports are fixedly secured to each belt respectively so that the first coin supports are in a symmetrical relationship with respect to the axis of the stacking space so that they can hold the lower face of the stacked coins cooperatively with each other; that coin location means are provided along the peripheral face of the stacking space so as to close the open faces between the inner travelling portions of the belts; and that the coins fed through the coin passage are stacked, one by one, in the stacking space while the inner opposite travelling portions are moved downwardly, the stacked coins being released to feed them to the next process when the coin supports pass the lower ends of the belts respectively. The driving means which moves the belts and the coin supports thereon also moves the second supports to positions ready for receiving the next coins to be introduced into the coin-receiving region at the upper end of the stacking space.

Other objects, features and advantages of the present invention will become apparent from the reading of the following description made in conjunction with the accompanying drawings.

BRIEF DESCRIPTION OF THE DRAWINGS

The accompanying drawings will be briefly described below, in which.

DETAILED DESCRIPTION OF THE PREFERRED EMBODIMENTS

Figure 1:
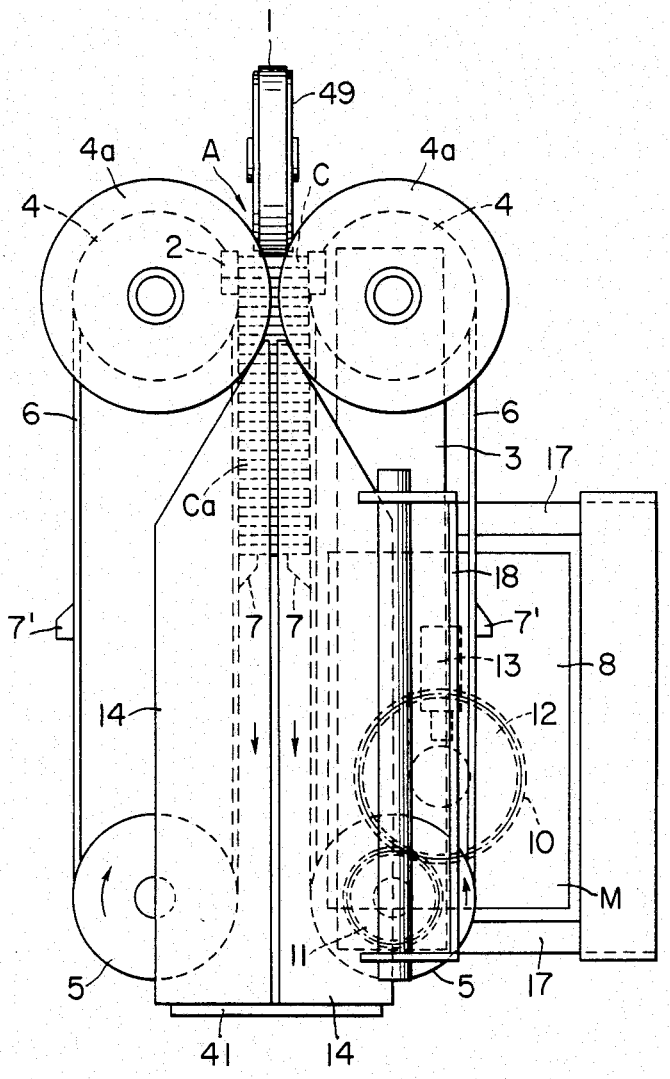
FIG. 1 is a front view of a coin stacking apparatus in accordance with a preferred embodiment of the present invention.
Figure 2:
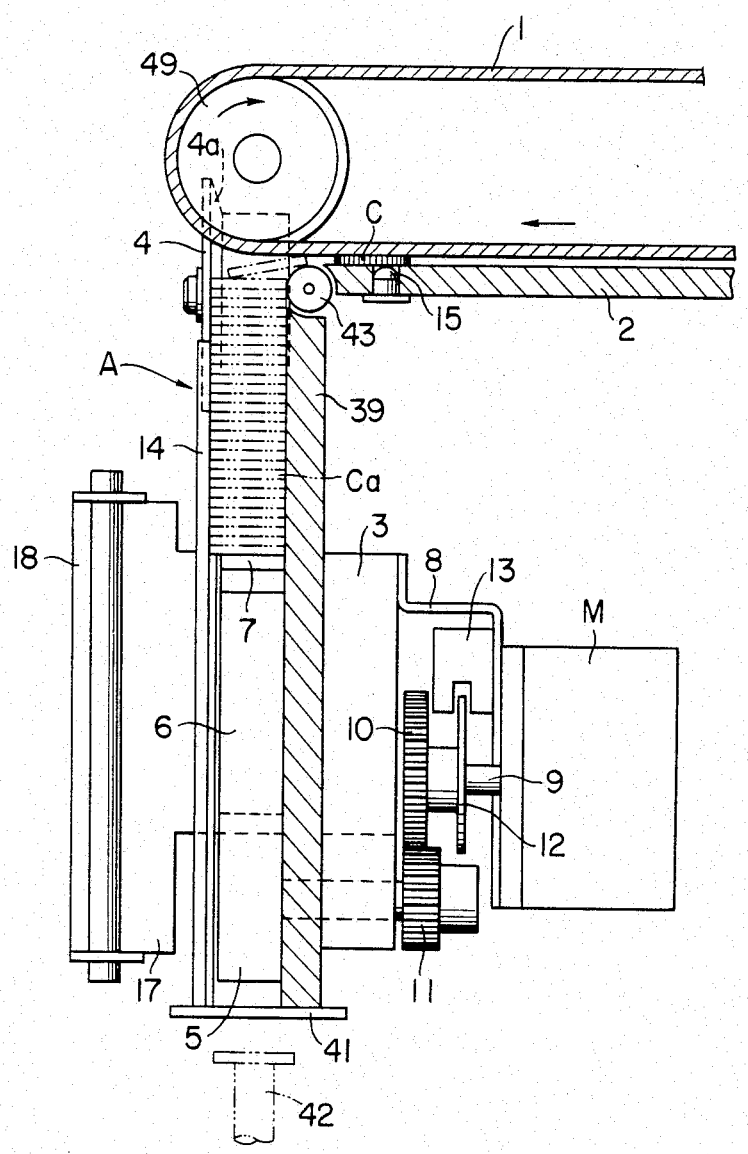
FIG. 2 is a side view of the coin stacking apparatus in FIG. 1.
Figure 3:
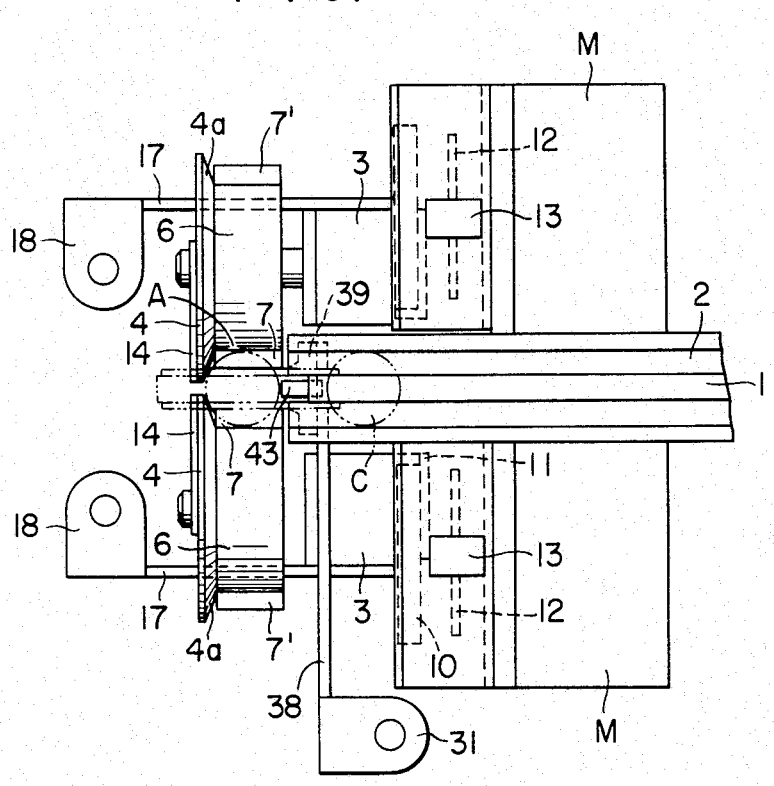
FIG. 3 is a plan view of the coin stacking apparatus in FIG. 1.

FIGS. 1 to 3 illustrate an embodiment where a coin stacking apparatus of the invention is employed as a coin stacking mechanism to be incorporated in a coin packing machine, wherein FIG. 1 is a front view of the coin stacking apparatus, FIG. 2 is a side view of the same and FIG. 3 is a plan view of the same.

Coins C to be stacked are conveyed to a coin stacking section A from a coin supply source (not shown) in the direction of an arrow mark with the aid of an endless less coin guiding conveyor belt 1 carried above a coin passage 2. Below the free end of the coin passage 2 are disposed a pair of support blocks 3 which serves to rotatably support a pair of upper pulleys 4 and a pair of lower pulleys 5. Between both the left-hand upper and lower pulleys 4 and 5 is extended an endless belt 6, whereas between both the right-hand upper and lower pulleys 4 and 5 is extended another endless belt 6. The pulleys guide the belts so that the inner travelling portions of the endless belts 6 are located opposite to one another with a certain distance kept therebetween. The coin stacking space between these belts 6 has an upper coin-receiving region and a lower stack-discharging end.

As is best seen from FIG. 3, each of the upper pulleys 4 includes a tapered edge **4*a* at the one side thereof. This provides means for closing the front of the coin-receiving region between the belts 6, and it locates the foremost end of the coin C to be stacked is exactly above the stacking space between the inner travelling portions of the endless belts 6**.

Each of the endless belts 6 includes a coin support 7 in the form of a bracket fixedly secured to the outer face thereof and the coin supports 7 are located symmetrically relative to both the left and right-hand endless belts 6. In the illustrated embodiment another coin support 7' is disposed on each of the endless belts 6 at an equal distance from the coin support 7 so as to allow two coin stackings to be effected at every one circulation of the endless belts 6.

A pulse motor M is fixedly mounted on each of the support blocks 3 with a plate 8 interposed therebetween, although only the right-hand pulse motor is illustrated in FIG. 1 for the purpose of simplification. On the shaft 9 of the pulse motor M is fixedly mounted a gear 10 which meshes with a gear 11 on the shaft of the lower pulley 5 whereby the latter is rotated in the direction of an arrow mark in FIG. 1.

Further, on the shaft 9 of the pulse motor M is fixedly mounted a detecting disc 12 of which peripheral part is projected into a slot on a sensor 13 firmly held on the plate 8 with a close clearance kept from the inside walls of the slot.

In order to shut the open space between the inner travelling portions of the endless belts 6 which are extended around both the upper and lower pulleys 4 and 5 and thereby prevent the coins C to be stacked from being thrown out through the front open face between the inner travelling portions a pair of front plates 14 fixed to the support blocks 3 are provided in juxtaposition with respect to the endless belts 6. Thus, the front plates 14 serve as a holding means with the back plate **3*c*** which will be mentioned hereinafter for holding the periphery of the coins C.

In the vicinity of the foremost end of the coin passage 2 is disposed a coin detecting device 15 with a photoelectric tube incorporated therein which serves to detect a passing coin C. When the passing coin C is detected by means of the coin detecting device 15, the latter generates a detecting pulse which is applied to the pulse motor M by way of a control section (see FIG. 5) whereby the pulse motor M is caused to rotate by a predetermined angle.

It should be noted that in view of the requirements for stacking a variety of coins C having a different outer diameter the coin stacking apparatus in accordance with the illustrated embodiment is provided with a space determining mechanism including a link mechanism for selectively determining the distance between both the left and right-hand endless belts 6 in the optimum manner in conformance with the kind of coin to be stacked.

Figure 4:
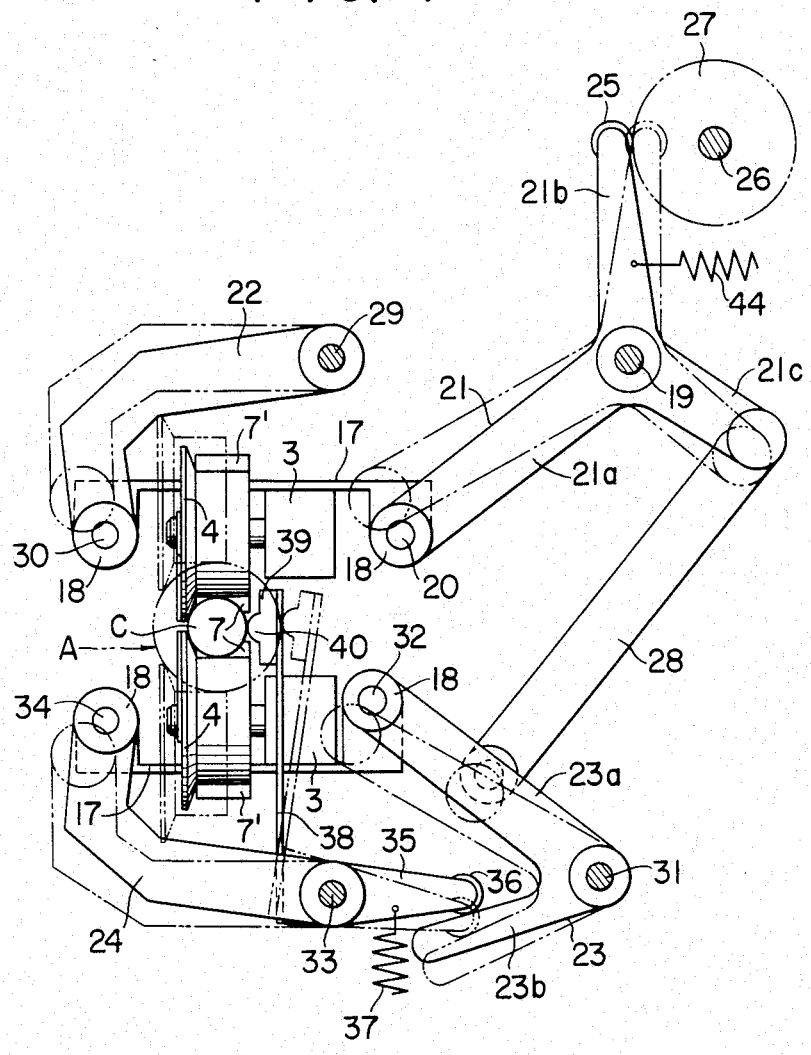
FIG. 4 is a plan view schematically illustrating a stacking space determining mechanism which serves to determine a distance between the downward travelling surfaces of the endless belts in dependence on a kind of coins to be stacked.

Specifically, as illustrated in FIG. 4, the stacking space determining mechanism is constructed such that the support blocks 3 are movably supported by means of a plurality of arms adapted to be actuated in conformance with the kind of coin to be stacked so as to make an adjustment with respect to the position where the support blocks 3 are to be located.

On the outer side wall of the support blocks 3 are fixedly disposed connecting plates 17 which are provided with bearings 18 at their end parts so that a first arm 21, a second arm 22, a third arm 23 and a fourth arm 24 are pivotally supported by means of said bearings 18, as illustrated in FIG. 4.

The first arm 21 serving to pivotally support the right end part of the upper support block 3 as seen in the drawing (the left-hand support block 3 as seen from the front) is designed in the Y-shaped configuration so that it is rotatable about a shaft 19 in a horizontal plane in the housing of the coin stacking apparatus, and the shaft 19 is located at the substantially central part of the first arm 21. The arm portion 21*a* of the first arm 21 is operatively engaged to the support block 3 by way of a shaft 20 pivotally fitted into the bearing 18, whereas the arm portion 21*b* of the first arm 21 includes a cam follower 25 rotatably held at the free end part thereof, and the cam follower 25 is brought in sliding contact against the cam face of an adjustment cam 27 on a shaft 26 under resilient force of a coil spring 44. The cam face of the adjustment cam 27 is designed so as to determine the position of the support blocks 3 in conformance with the kind of coins to be stacked. Further, the arm portion 21*c* of the first arm 21 is operatively engaged to a joint link 28 pivotally held at the free end thereof.

The left end part of the upper support block 3 as seen in the drawing is pivotally engaged to the free end of the second are 22 by way of a shaft 30 pivotally fitted into the bearing 18 and the base portion of the second arm 22 is rotatably supported by means of a shaft 29 in the housing of the coin stacking apparatus.

The third arm 23 serving to pivotally support the right end part of the lower support block 3 as seen in the drawing (the right-hand support block 3 as seen from the front) is designed in the V-shaped configuration so that the bent portion of the third arm 23 is rotatably supported by means of a shaft 31 in the housing. The arm portion 23*a* of the third arm 23 is operatively engaged to the right end part of the lower support block 3 by way of a shaft 32 pivotally fitted into the bearing 18.

The left end part of the lower support block 3 as seen in the drawing is pivotally engaged to the free end of the fourth arm 24 by way of a shaft 34 pivotally fitted into the bearing 18, whereas the base portion of the fourth arm 24 is rotatably supported by means of a shaft 33 held in the housing.

The lower end of the joint link 28 as seen in the drawing is operatively connected to the middle part of the arm portion 23*a* of the third arm 23. Thus, as the first arm 21 is rotated by means of the adjustment cam 27 within the extent as defined between the positions identified by the real lines and the chain lines in FIG. 4 in conformance with the kind of coins to be stacked, both the upper and lower support blocks 3 are caused to move away from or toward one another while they are located in parallel to one another. As a result the distance between the inner travelling portions of endless belts 6 is selectively determined so as to fit the outer diameter of the coins.

Further, onto the shaft 33 of the fourth arm 24 is fitted the base portion of a fifth arm 35 which includes a roller 36 at the free end thereof, and roller 36 is brought in rolling contact against the inner face of the arm portion 23*b* of the third arm 23 under resilient force of a coil spring 37. A connecting plate 38 is fixedly secured to the base portion of the fifth arm 35 and extends upward as seen in the drawing until the upper end part of the connecting plate 38 is exposed to the stacking space as defined by the endless belts 6 at the position located opposite to the front plates 14. A back plate 39 is fixedly secured to the aforesaid upper end part of the connecting plate 38. The back plate 39 serves to shut the rear open face of the stacking space between the inner travelling endless belts 6 and at the same time functions as a holder for holding the peripheral part of the coin C. In view of the requirement for stacking coins having a smaller diameter the back plate 39 is formed with a projection 40 having a mountain-shaped sectional configuration which is designed so as to project toward the stacking space between the endless belts to a certain extent.

In FIGS. 1 and 2, reference numeral 41 designates a shutter disposed at the lowermost end of the coin stacking section A, and the shutter 41 is adapted to be opened when a stacked structure of coins Ca is delivered onto a holding rod 42 in a packaging section. Further, reference numeral 43 designates a bearing located at the foremost end of the coin passage 2. The bearing 43 closes the rear of the coin-receiving region between the belts, and it ensures a smooth introduction of the coin C into the stacking space as defined by the downward travelling belts 6.

Figure 5:
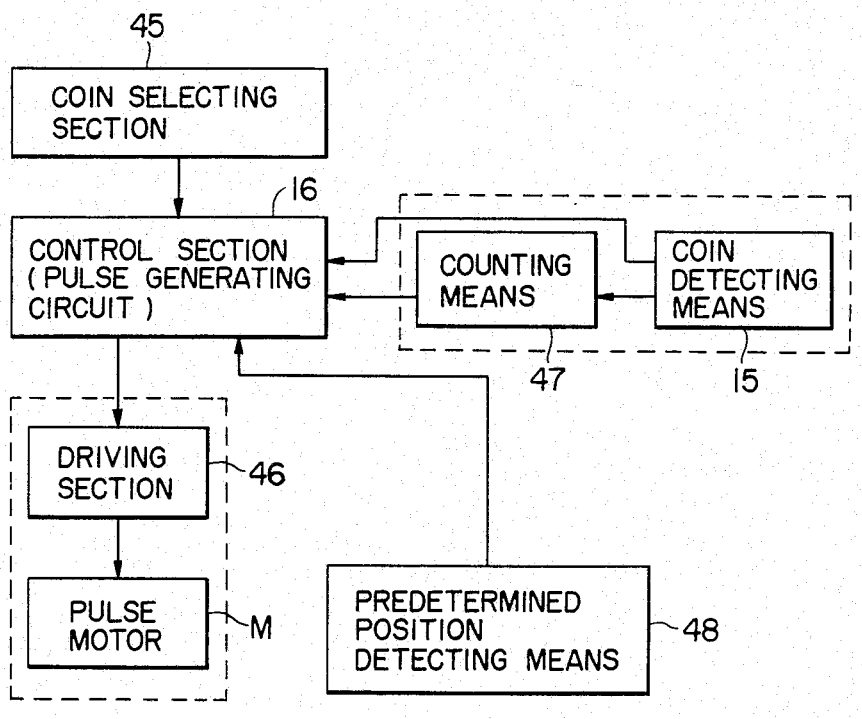
FIG. 5 is a block diagram for a control system for the coin stacking apparatus.

FIG. 5 is a block diagram for a control system for a coin stacking apparatus including a coin selecting section 45 which is constructed such that when a kind of coin to be stacked is determined by rotating a knob (not shown) a signal is issued therefrom and it is then inputted into a control section 16 (including a pulse generating circuit). Further, a coin detecting signal generated in the coin detecting means 15 disposed in the coin passage 2 is inputted into the control section 16 so that a certain number of pulses are delivered to a driving means 46. On the other hand, the detecting signal from the coin detecting means 15 is transmitted to a counting means 47 and when a predetermined number of coins are counted a signal of completion of counting is transmitted from the counting means 47 to the control section 16. Another signal is then issued to the driving section 46 and the pulse motor M continues its rotation until a signal from a predetermined position detecting means 48 (comprising the detecting disc 12 and the sensor 13) is delivered to the control section 16. When a predetermined position detecting signal is issued, the pulse motor M comes to a stop.

If it is assumed that a single pulse causes the pulse motor M to rotate by 1/200 revolution and the endless belts 6 have a travelling speed of 0.9 mm/sec, the result is that an angle of rotation caused by a single pulse amounts to 1.8 degree and a piece of coin C is conveyed to the stacking space by every two pulses in case of the coin C having a thickness of 1.5 mm. Thus, successive coin stackings are carried out one after another with corrective pulses added in the cource of the intended coin stacking operation.

Next, operations of the coin stacking apparatus in accordance with the illustrated embodiment will be described below.

First, the knob for determining a kind of coins to be stacked (not shown) is manually rotated and the adjustment cam 27 is actuated depending on the rotation of the knob whereby the first arm 21 is turned by means of the cam follower 25 which comes in rolling contact with the cam face of the adjustment cam 27.

When the kind of coins is determined and they have a small diameter, the first to fourth arms 21 to 24 are actuated toward the position as identified with real lines in FIG. 4 and thereby both the upper and lower support blocks 3 move toward one another to reduce the distance between the inner travelling endless belts 6 to such an extent as to fit the coins C to be stacked. On the other hand, when the coins have a large diameter, the arms 21 to 24 are actuated toward the position as identified with chain lines in FIG. 4 and thereby the support blocks 3 move away from one another to enlarge the distance between the endless belts 6. After completion of adjustment of the distance the fifth arm 35 is actuated by way of the third arm 23 and the back plate 39 fixedly secured to the fifth arm 35 moves forward together with the projection 40 to the position determined in dependence on the diameter of the coins to be stacked so as to guide the peripheral part of a stacked structure of coins Ca.

At this moment the coin supports 7 on the left and right-hand endless belts 6 are located in the proximity of the foremost end of the coin passage 2. As the coin C delivered from the coin delivery section (not shown) is conveyed on the coin passage 2 by means of the coin guiding conveyor belt 1, it moves over the bearing 43 and enters the stacking space as defined by the endless belts 6 smoothly until it rides on both the coin supports 7 with the aid of the edge 4*a* of the upper pulley 4 which serves to define the positional limit for the delivered coin.

When any passing of the coin C by the coin detecting means 15 is detected by means of the latter in the coin passage 2, a detection signal is transmitted therefrom into the control section 16, causing the pulse motor M to be rotated by an angle of rotation equivalent to the predetermined number of pulses, whereby the lower pulleys 5 are rotated by means of the pulse motor M via a combination of the gears 10 and 11 and thereby the inner travelling portions of the endless belts 6 are lowered by a distance equivalent to the thickness of a single coin. Thus, the coins C discharged from the foremost end of the coin passage 2 into the stacking space defined by both the endless belts 6 are stacked one by one in the aforesaid stacking space in the above-described manner.

The existing number of stacked coins is counted by means of the counting means 47 and the counting signal obtained in that way is transmitted to the control section 16 so that the pulse motor M continues its rotation until the sensor 13 detects the predetermined position where a predetermined number of coins are stacked using the detecting disc 12. After it is detected that the predetermined number of coins are stacked, the pulse motor M comes to a stop.

At this moment the conveyor belt 1 is stopped and thereby movement of the coins C on the coin passage 2 is interrupted while the counting mechanism becomes inoperative.

After the stacked structure of coins Ca rides on both the coin supports 7 in the stacking space as defined by the inner travelling endless belts 6, it is lowered as the endless belts 6 carry out their downward circulative movement. When it reaches the lowermost end of the stacking space, the coin supports 7 move away from one another in the outward direction, causing the stacked structure of coins to be placed on the shutter 41.

As is apparent from FIG. 1, as the coin supports 7 move away from one another, the other coin supports 7' come into the position in the stacking space where they are ready for receiving the delivered coins C to be stacked and at the same time the counting mechanism becomes operative again. Then, stacking operation is initiated for the coins C delivered by means of the conveyor belt 1.

At this moment the stacked structure of coins Ca previously placed on the shutter 41 is lowered on a holding rod 42 by opening the shutter 41, and the holding rod 42 is located beneath the latter.

It should be noted that the illustrated embodiment has been described above with respect to the arrangement that the pulse motors M are mounted on both the left and right-hand support blocks 3 so as to drive the lower pulleys 5 for the endless belts 6 but the present invention should be not limited only to this and a single pulse motor M may be mounted on either of the support blocks 3 so as to drive one of the lower pulleys 5 which in turn drives the other one by way of a certain transmission mechanism disposed therebetween. Further, the coin detecting means 15 may be any type of detecting device using a photoelectric tube, a proximity switch or the like. In the illustrated embodiment a combination of the detecting disc 12 and the sensor 13 is employed for the purpose of detecting the predetermined position of the endless belts 6. Alternatively, detection may be effected by directly detecting the predetermined position of the coin supports 7 with the aid of a microswitch, photoelectric tube or the like. If there is no necessity for stacking a predetermined number of coins but only counting of the number of coins is required for any reason, it is advisable that both the left and right-hand endless belts 6 are displaced away from one another with a sufficiently wide distance kept therebetween and a suitable guide means exclusively for the purpose of counting the number of coins is fitted into the empty space as defined by the endless belts 6.

Figure 6:
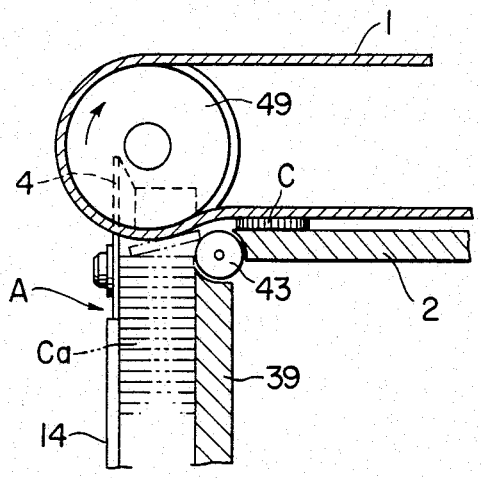
FIG. 6 is a partial side view of the coin stacking apparatus in accordance with a modified embodiment of the present invention.

FIG. 6 illustrates a part of the coin stacking apparatus in accordance with a modified embodiment of the invention. As is apparent from the drawing, the coin receiving section is illustrated and the modification consist in that a pulley 49 located at the foremost end of the conveyor belt 1 is appreciably lowered in comparison with that in the preceding embodiment. Owing to the arrangement the pulley 49 is effective in depressing the coin C delivered to the coin stacking section A and both the left and right-hand endless belts 6 are circulatively driven downward by the depressing force imparted to the coin C by the pulley 49.

Specifically, the pulley 49 at the foremost end of the conveyor belt 1 is disposed such that its lower end is located a little bit lower than the surface of the coin passage 2 and the pulse motor M is replaced with a motor with a braking mechanism incorporated therein. Thus, the endless belts 6 are kept stopped while the motor is inoperative due to the braking force imparted by the braking mechanism, until a driving signal is issued to the motor. It should be noted that in FIG. 6 the same parts and components as those in the preceding embodiment are identified with the same reference numerals and thus their repeated description is omitted for the purpose of simplification.

The coin stacking apparatus in accordance with the modified embodiment can be operated without necessity for any pulse motor and therefore it can be manufactured at an inexpensive cost because of the arrangement of a simplified control system.

In the modified embodiment as illustrated in FIG. 6 the pulley 49 is employed but it may be replaced with a roller which serves for depressing a coin to be stacked, and the roller is disposed independently of the pulley 49.

As is readily understood from the above description, the first apparatus invention consists in that prior to packing a predetermined number of coins a stacked structure of coins in the form of a cylinder is prepared by way of the steps of receiving a coin on a pair of coin supports fixedly secured to the inner travelling portions of a pair of endless belts with a certain distance kept therebetween in the stacking space as defined by said endless belts, lowering the coin supports stepwise by distance equivalent to the thickness of the coin and repeating the above two steps until the predetermined number of coins are stacked on the coin supports. After the predetermined number of coins are stacked, the endless belts are circulatively driven and the coin supports move away from one another in the outward direction whereby the stacked structure of coins is automatically removed from the stacking space and it is then displaced to a next process. On the other hand, the coin supports move up together with the endless belts to resume the initial stacking position where a coin to be stacked is received thereon. Owing to the arrangement as described above there is no necessity for the conventional complicated mechanism for actuating up or down a receiving plate and an idle period of time that elapses until next stacking operation is initiated is substantially reduced, resulting in coin processing at a high speed ensured.

Further, if plural pairs of coin supports are provided on the endless belts, coin processing is ensured at a higher operative speed.

Furthermore, if a certain clearance is always kept between the upper face of the stacked structure of coins and the surface of the coin passage, it is ensured that introduction of coins to be stacked is effected smoothly, resulting in reliable coil stacking at a high operative speed ensured.

While the present invention has been described above merely with respect to the illustrated embodiments, it should be of cource understood that the present invention should be not limited only to them and various changes or modifications may be made in the optimum manner without any departure from the spirit and scope of the invention.

What is claimed is:

1. A coin stacking apparatus for stacking vertically in a stacking space a plurality of coins fed horizontally along a coin passage in a coin disposing machine such as a coin packaging machine or the like; said stacking space having an upper end where coins are received from the coin passage and a lower end which is released after a predetermined number of coins have been stacked so that the stacked coins discharged from the stacking space, comprising:

(a) a pair of endless belts disposed substantially vertically and having inner vertical travelling portions, respectively, which are opposite to each other to define the sides of the stacking space with a certain distance kept therebetween, the inner vertical travelling portions being moved downwardly together with each other, (b) belt guides means for guiding the endless belts so as to form the inner vertical travelling portions, said belt guide means having at least two pulleys which are located opposite to each other in upper portions of the respective inner vertical travelling portions so that the opposite portions of the respective endless belts running along the pulleys provide a coin-receiving region at the upper end of the stacking space, (c) at least two coin supports fixedly secured to each of said belts respectively in a symmetrical relationship with respect to the axis of the stacking space, said coin supports on the opposite inner vertical travelling portions being cooperable with each other in pairs to support the lower end of a stack of coins, (d) first coin locating means for locating the foremost end of each coin conveyed horizontally exactly above the stacking space, said first coin locating means being positioned at the front of the stacking space between the belts, (e) second coin locating means positioned at rear of the stacking space between the belts, (f) coin guide means extending over the coin-receiving region for guiding the upper surface of each coin which is delivered into the stacking space, (g) said inner travelling portions of the belts being movable downwardly in response to the introduction of each coin into the stacking space, and driving means operable after a predetermined number of coins have been stacked in the stacking space to move the endless belts so that first said supports holding the lower face of the stacked coins move downwardly to permit the discharge of a stack of coins from the stacking space and second said supports move into positions ready for receiving the next coins introduced from the coin passage into the coin-receiving region of the stacking space, and (h) shutter means at the lower end of the stacking space for receiving the stacked coins, said shutter means being movable to an open position to permit the discharge of a stack of coins from the stacking space.

2. A coin stacking apparatus according to claim 1, wherein the coin supports on each belt are equally spaced so that when a first support on the belt releases the stacked coins to the shutter means, the second support on the belt is located in a position ready to receive the next coins introduced into the stacking space.

3. A coin stacking apparatus according to claim 1, wherein the belts are relatively movable to change the distance between the inner travelling portions according to the kind of coins to be stacked, the locations of the first and second coin locating means being also changeable according to the distance between the endless belts.

4. A coin stacking apparatus according to claim 1, wherein the driving means is operable to lower together the inner portions of the endless belts and the coin supports thereon stepwise each time a coin is delivered into the stacking space; coin selecting means for selecting a kind of coin to be stacked; coin detecting means in the coin passage for detecting the passing of a coin to be stacked before the coin is fed into the stacking space; said driving means being operable in response to signals from the coin selecting means and from the coin detecting means to lower the inner travelling portions of the belts stepwise through a distance corresponding to the thickness of a coin whereby a height difference is always kept between the stacked coins and the coin guide means in spite of the kind of coins and the number of coins to be stacked.

5. A coin stacking apparatus according to claim 1, having counting means for generating a signal when it counts a predetermined number of coins to be stacked, predetermined position detecting means for generating a signal when a pair of supports on the respective endless belts are located in positions for receiving the next coins for the next stack of coins, said driving means being operable to start in response to the signal from the counting means and to stop in response to the signal from the predetermined position detecting means.

6. A coin stacking apparatus according to claim 5, wherein the driving means includes at least one pulse motor which is operatively connected to a pulley of the belt guide means.

7. A coin stacking apparatus according to claim 1, wherein the coin guide means includes a conveyor belt means for contacting the coins and sliding them horizontally in the coin passage, a conveyor belt pulley located over the stacking space and supporting the conveyor belt means, said conveyor belt pulley having a peripheral surface with a lower portion which depresses each coin toward the coin-receiving area of the stacking space to drive the inner travelling portions of the endless belts in a downward direction.

* * * * *